US006012945A

United States Patent [19]

Tabor et al.

[11] Patent Number: 6,012,945

[45] Date of Patent: Jan. 11, 2000

[54] ELECTRICAL CONNECTOR FOR CONNECTION TO A FUEL INJECTOR

[75] Inventors: William R. Tabor, Livonia; Harry Zaverzence, Macomb Township; Frank Povilaitis, Troy, all of Mich.

[73] Assignee: Chrysler Corporation, Auburn Hills, Mich.

[21] Appl. No.: 08/921,487

[22] Filed: Sep. 2, 1997

[51] Int. Cl.[7] ..... H01R 3/00

[52] U.S. Cl. ..... 439/489

[58] Field of Search ..... 439/489, 350–358, 439/488

[56] References Cited

U.S. PATENT DOCUMENTS 5,643,003 7/1997 Myer et al. ..... 439/352

5,681,178 10/1997 Kunkle et al. ..... 439/352

5,775,930 7/1998 Model et al. ..... 439/352

*Primary Examiner*—Steven L. Stephan

*Assistant Examiner*—Eugene G. Byrd

*Attorney, Agent, or Firm*—James R. Yee

[57] ABSTRACT

An electrical connector for connection to a fuel injector in a motor vehicle includes a terminal insulator having at least one passage to receive at least one box terminal staked wire and a connector position assurance member cooperating with the terminal insulator to detect and indicate an unmated condition of the terminal insulator to a mating connector of the fuel injector wherein the connector position assurance member includes a preload stop finger engageable with the terminal insulator to prevent the connector position assurance member from prematurely locking to the mating connector.

20 Claims, 2 Drawing Sheets

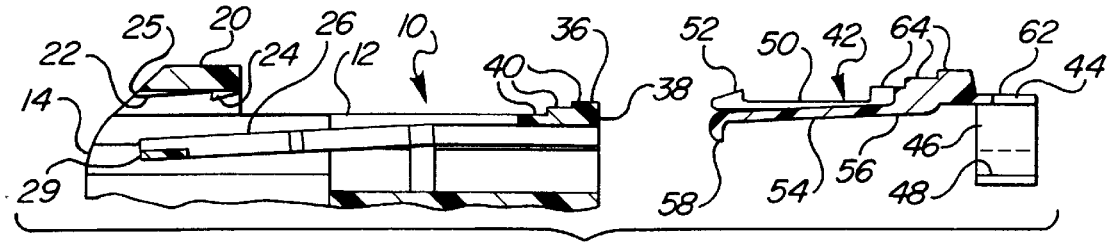
FIG-4
FIG-5
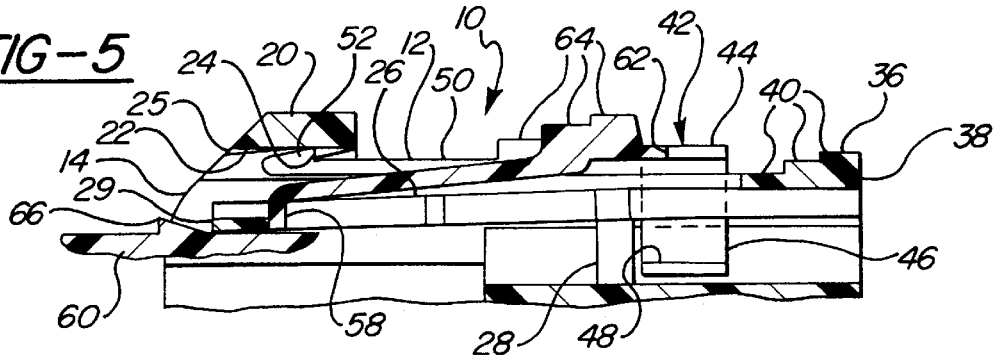
FIG-6
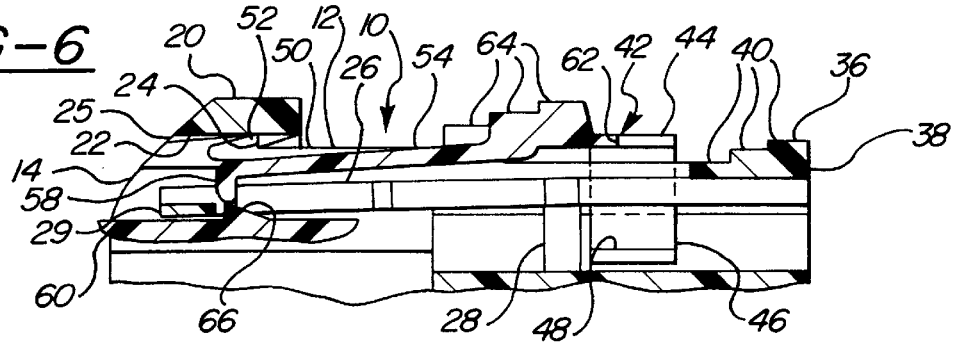
FIG-7
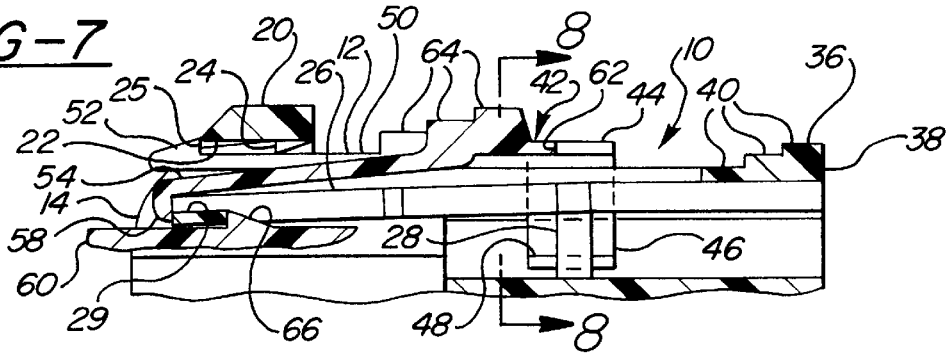
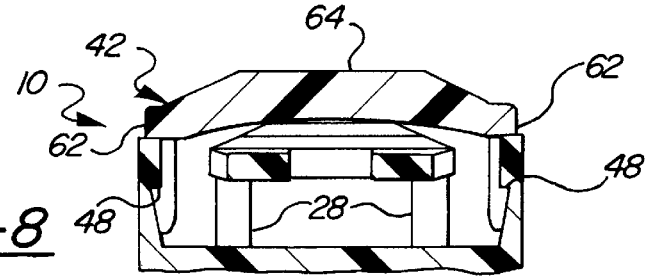
FIG-8

ELECTRICAL CONNECTOR FOR CONNECTION TO A FUEL INJECTOR

BACKGROUND OF THE INVENTION

1. Field of the Invention

The present invention relates generally to electrical connectors and, more particularly, to an electrical connector for connection to a fuel injector in a motor vehicle.

2. Description of the Related Art

Electrical connectors have been provided to connect and retain wires together on a motor vehicle. These electrical connectors typically include a terminal insulator having box terminal staked wires and a latch to connect the terminal insulator to a mating connector of the fuel injector.

One disadvantage of these electrical connectors is that the latch may prematurely lock to the mating connector of the fuel injector during assembly. Another disadvantage is that the latch may require an auditory confirmation of proper assembly which is difficult under noisy assembly conditions. Yet another disadvantage is that the latch may not properly retain the electrical connector to the mating connector of the fuel injector. Thus, there is a need in the art to provide an electrical connector for connection to a fuel injector in a motor vehicle which in a simple manner allows improved retention, visually identifies complete latch engagement, and eliminates premature locking.

SUMMARY OF THE INVENTION

It is, therefore, one object of the present invention to provide an electrical connector for connection to a fuel injector in a motor vehicle.

It is another object of the present invention to provide an electrical connector for connection to a fuel injector in a motor vehicle that eliminates premature locking of the connector positioning assurance member.

It is yet another object of the present invention to provide an electrical connector for connection to a fuel injector in a motor vehicle which improves retention of a connector positioning assurance member to the electrical connector.

To achieve the foregoing objects, the present invention is an electrical connector for connection to a fuel injector in a motor vehicle including a terminal insulator having at least one passage to receive at least one box terminal staked wire. The electrical connector also includes a connector position assurance member cooperating with the terminal insulator to detect and indicate an unmated condition of the terminal insulator to a mating connector of the fuel injector. The connector position assurance member includes a preload stop finger engageable with the terminal insulator to prevent the connector position assurance member from prematurely locking to the mating connector.

One feature of the present invention is that an electrical connector is provided for connection to a fuel injector in a motor vehicle. Another feature of the present invention is that the electrical connector has an extending beam to eliminate premature locking. Yet another feature of the present invention is that the electrical connector has a preload stop finger to improve retention of a connector position assurance member to the electrical connector and a mating connector of the fuel injector. A further feature of the present invention is that the electrical connector includes a connector position assurance member which detects a partially unmated condition to a mating connector and indicates the proper installation of the terminal insulator to the mating connector.

Other objects, features and advantages of the present invention will be readily appreciated as the same becomes better understood after reading the subsequent description taken in conjunction with the accompanying drawings.

BRIEF DESCRIPTION OF THE DRAWINGS

FIG. 4 is a fragmentary elevational view of the electrical connector of FIG. 1 illustrating the preload stop finger in a preload assembly position.

FIG. 5 is a fragmentary elevational view of the electrical connector of FIG. 1 illustrating the connector position assurance member in final assembly position and a fuel injector mating connector in an unlocked position.

FIG. 6 is a fragmentary elevational view of the electrical connector of FIG. 1 illustrating the connector position assurance member in final assembly position and a fuel injector mating connector moving a preload stop finger out of a preload assembly position.

FIG. 7 is a fragmentary elevational view of the electrical connector of FIG. 1 having a fuel injector mating connector and a preload stop finger in locked position.

FIG. 8 is a sectional view taken along line 7—7 of FIG. 7.

DESCRIPTION OF THE PREFERRED EMBODIMENT(S)

Figure 1:
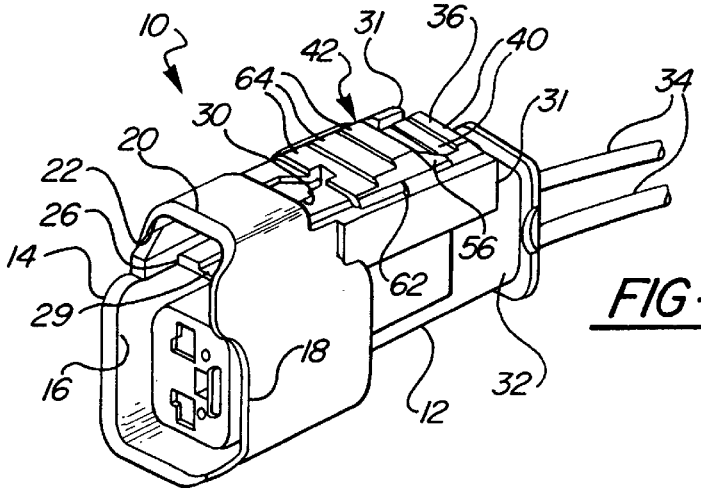
FIG. 1 is a perspective view of an electrical connector, according to the present invention, illustrating a connector position assurance member in a preload assembly position.
Figure 2:
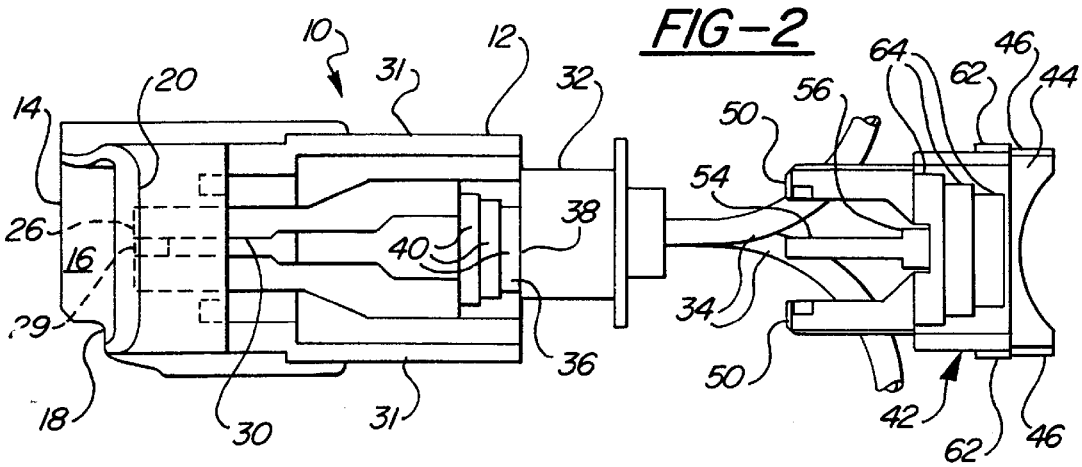
FIG. 2 is a plan view of the electrical connector of FIG. 1 in an unassembled position.
Figure 3:
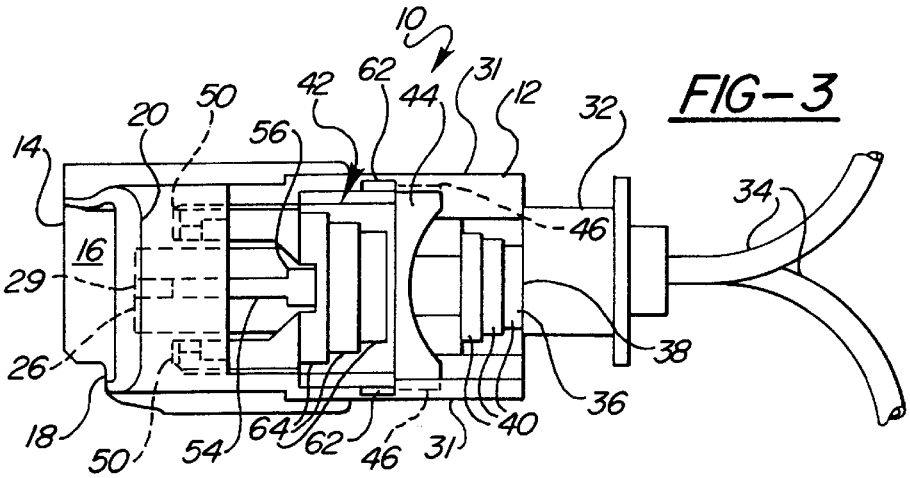
FIG. 3 is a plan view of the electrical connector of FIG. 1 illustrating the connector position assurance member in a final assembly position.

Referring to FIGS. 1 through 4, an electrical connector 10, according to the present invention, is shown for connection to a fuel injector in a motor vehicle (not shown). The electrical connector 10 is used for receiving and retaining box terminal staked wires (not shown) for connection to a mating connector of the fuel injector in the motor vehicle. It should be appreciated that box terminal staked wires are conventional and known in the art.

The electrical connector 10 includes a terminal insulator 12 for receiving the box terminal staked wires. The terminal insulator 12 is preferably a one-piece molded plastic member. The terminal insulator 12 includes a forward engaging shroud 14 having a cavity 16 contoured to receive and align a suitably designed mating connector 60 (partially shown in FIGS. 5 through 7) of the fuel injector. Preferably, the shroud 14 and cavity 16 extend longitudinally and are generally rectangular in shape. The cavity 16 has a polarizing portion 18 which is a cut away from a portion of the forward engaging shroud 14. It should be appreciated that the polarizing portion 18 prevents assembly of the terminal insulator 12 to an incorrect mating connector.

The terminal insulator 12 includes a hood 20 extending vertically from an upper side of the shroud 14. The hood 20 is generally rectangular in shape and has an aperture 22 extending longitudinally therethrough. The hood 20 includes a first locking projection or rib 24 which extends transversely and into the aperture 22 to provide a locking surface for a connector position assurance member 42 to be described. The hood 20 also includes a second locking projection or rib 25. The second locking projection 25 provides a locking surface for the connector position assurance member 42, discussed subsequently, once it is in its fully locked position to be described.

The terminal insulator 12 also includes a latch 26 disposed between the shroud 14 and hood 20. The latch 26 extends longitudinally and is cantilevered by a connecting portion 28 to the shroud 14. The latch 26 includes a recessed distal end 29. The latch 26 has a slot 30 extending therethrough and ends at the recessed distal end 29. The slot 30 extends longitudinally and is generally rectangular in shape for a function to be described. The terminal insulator 12 includes a pair of ribs 31 spaced transversely and extending longitudinally from the hood 20 the length of the latch 26. The hood 20 and ribs 31 protect the latch 26 from damage during shipping and handling. It should be appreciated that the ribs 31 are integral and formed as one piece with the hood 20. It should also be appreciated that the latch 26 is integral and formed as one piece with the shroud 14. It should further be appreciated that the connecting portion 28 allows the latch 26 to be flexed or deflected.

The terminal insulator 12 further includes a terminal receiving portion 32 extending longitudinally from the shroud 14 to receive terminal wires 34. The terminal receiving portion 32 includes at least one passage (not shown) extending longitudinally therethrough and communicating with the cavity 16.

The latch 26 includes a pressure lock 36. The pressure lock 36 terminates the slot 30 at a second cantilevered end 38 of the latch 26. The pressure lock 36 includes at least one elevated surface 40. In one embodiment, the pressure lock 36 includes three elevated surfaces 40. The pressure lock 36 retains a connector position assurance member 42 with the terminal insulator 12 until the connector position assurance member 42 is in the final assembly position (FIG. 7).

The connector position assurance member, generally shown at 42, includes a base wall 44 and side walls 46 forming a generally inverted U-shape. The side walls 46 each have a stabilizing appendage 48 extending transversely toward each other which retain the connector position assurance member 42 to the insulator 12. It should be appreciated that the stabilizing appendages 48 have reverse (back) angles to improve retention of the connector position assurance member 42 to the latch 26.

The connector position assurance member 42 includes at least one preload locking projection 50 extending outwardly from the base wall 44. In one embodiment, the connector position assurance member 42 includes two preload locking projections 50. Each of the preload locking projections 50 includes a retainer 52 extending upwardly therefrom. The retainers 52 engage the first locking projection 24 when the connector position assurance member 42 is in the preload assembly position as shown in FIGS. 5 and 6. The retainers 52 engage the second locking projection 25 when the connector position assurance member 42 is in the locked position as shown in FIG. 7. Although not shown in the FIGS., the retainers 52 may extend across the entire distal end of the preload locking projections. It should be appreciated that the hood 20 guides and retains the connector position assurance member 42. It should also be appreciated that the hood member 20 also protects the latch 26 from compression set during packaging and shipping conditions.

The connector position assurance member 42 includes a preload stop finger 54 which is a longitudinally tapered beam that is cantilevered to the base wall 44 by a connecting portion 56 and disposed between the side walls 46. The preload stop finger 54 includes a finger projection 58 extending generally perpendicular therefrom to engage the slot 30 in the latch 26. The preload stop finger 54 prevents the connector position assurance member 42 from traveling past the first locking projection 24 on the terminal insulator 12 by the finger projection 58 abutting the recessed distal end 29 of the slot 30 in the latch 26. The preload stop finger 54 is deflected upon assembly of the electrical connector 10 with the mating connector 60 of the fuel injector to disengage the finger projection 58 from the slot 30 which allows the connector position assurance member 42 to move in a longitudinal direction along the latch 26 until it assumes the final assembly position of FIG. 7. It should be appreciated that the preload stop finger 54 causes wedging action when it moves forward to hold the latch 26 in a locked position at final assembly to the fuel injector.

The preload stop finger 54 of the connector position assurance member 42 also includes at least one, preferably a pair of guides 62 extending outwardly on each side wall 46 to provide support for the connector position assurance member 42 as it is slid along two ribs 31 of terminal insulator 12. The connector position assurance member 42 also includes an installation projection 64 extending from the base wall 44 which provides an area to apply a compressive force by an operator to slide the connector position assurance member 42 into its final assembly position.

In operation, the connector position assurance member 42 is aligned and retained by the latch 26. In the preload assembly position illustrated in FIGS. 1 and 5, the stabilizing appendages 48 are disposed about the latch 26 with the finger projection 58 disposed in the slot 30 of the latch 26 not yet abutting the recessed distal end 29. The preload locking projection 50 is disposed longitudinally past the locking rib 24 outside the hood 20. When willful and suitable pressure is applied to the connector position assurance member 42, the connector position assurance member 42 slides forward such that the preload locking projection 50 is disposed on the other side of the locking rib 24 and the finger projection 58 moves in the slot 30 until it abuts the recessed distal end 29 thereby preventing sliding motion of the connector position assurance member 42. The terminal insulator 12 is mated or installed to the mating connector 60 of the fuel injector which is received in the cavity 16 of the shroud 14. The preload stop finger 54 is deflected when a nib 66 of the mating connector 60 of the fuel injector pushes the finger projection 58 up and out of abutting engagement with the recessed distal end 29. The connector position assurance member 42 is then slid forward by the operator until the guides 62 abut the hood 20. The preload stop finger 54 provides additional locking force by forcing the recessed distal end 29 downwardly such that the recessed distal end 29 positively abuts the nib 66.

Accordingly, the electrical connector 10 has two preassembled components, the terminal insulator 12 and the connector position assurance member 42. The connector position assurance member 42, permanently assembled to the terminal insulator 12, will detect when the terminal insulator 12 is properly mated with the mating connector 60 of the fuel injector and provide a more positive locking engagement therebetween.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An electrical connector for connection to a fuel injector in a motor vehicle comprising:

a terminal insulator having at least one passage to receive at least one box terminal staked wire, said terminal insulator further including a latch having a longitudinally extending slot; and a connector position assurance member cooperating with said terminal insulator to detect and indicate an unmated condition of said terminal insulator to a mating connector of the fuel injector, said connection position assurance member operative to engage said terminal insulator in a preload assembly position and a locked position, said connector position assurance member including a preload stop finger engageable with said terminal insulator to prevent said connector position assurance member from prematurely locking to the mating connector, said preload stop finger having a portion retained in said slot when said connection position assurance member engages said terminal insulator in said preload assembly position.

2. The electrical connector as set forth in claim 1 wherein said terminal insulator includes a latch for locking a nib of the mating connector to said terminal insulator.

3. The electrical connector as set forth in claim 2 wherein said latch includes a recessed distal end for abutting said preload stop finger prior to locking the nib of the mating connector to said terminal insulator.

4. The electrical connector as set forth in claim 3 wherein said preload stop finger includes a finger projection for engaging said recessed distal end after the nib of the mating connector is locked to said recessed distal end.

5. The electrical said connector as set forth in claim 1 wherein connector position assurance member includes said preload locking projection extending out therefrom to lock said connector position assurance member in a preload assembly position with respect to said terminal insulation.

6. The electrical connector as set forth in claim 5 wherein said terminal connector includes a hood extending over a portion of said latch.

7. The electrical connector as set forth in claim 6 wherein said hood includes a first locking projection to engage said preload locking projection when said connector position assurance member is in the preload assembly position with respect to said terminal insulator.

8. The electrical connector as set forth in claim 7 wherein said hood includes a second locking projection disposed adjacent said first locking projection to engage said preload locking projection when said connector position assurance member is in said locked position with respect to said terminal insulator.

9. The electrical connector as set forth in claim 1 wherein said connector position assurance member is preassembled to said terminal insulator.

10. The electrical connector as set forth in claim 1 wherein said terminal insulator has a forward engaging shroud including a cavity to receive a mating connector.

11. The electrical connector as set forth in claim 10 wherein said cavity includes a polarizing portion which aligns and prevents misassembly to the mating connector.

12. An electrical connector for connection to a fuel injector in a motor vehicle comprising:

a terminal insulator having at least one passage to receive at least one box terminal staked wire and a latch for locking a nib of the mating connector to said terminal insulator, said latch defining an elongated slot; and a connector position assurance member cooperating with said terminal insulator to detect and indicate an unmated condition of said terminal insulator to a mating connector of the fuel injector, said connector position assurance member including a preload stop finger disposed in said elongated slot of said terminal insulator to prevent said connector position assurance member from prematurely locking to the mating connector, said connector position assurance member including a preload locking projection extending out therefrom to lock said connector position assurance member in a preload assembly position with respect to said terminal insulation.

13. The electrical connector as set forth in claim 1 wherein said connector position assurance member includes a base wall and a pair of side walls defining a generally inverted U-shape.

14. The electrical connector as set forth in claim 13 wherein said stop finger of said connector position assurance member is cantilevered to said base wall and disposed between said side walls.

15. The electrical connector as set forth in claim 13 wherein said terminal insulator includes a pair of laterally spaced apart walls, said pair of side walls of said connector position assurance member engaging said pair of laterally spaced apart walls of said terminal insulator.

16. The electrical connector as set forth in claim 12 wherein said connector position assurance member includes a base wall and a pair of side walls defining a generally inverted U-shape.

17. The electrical connector as set forth in claim 15 wherein said stop finger of said connector position assurance member is cantilevered to said base wall and disposed between said side walls.

18. The electrical connector as set forth in claim 16 wherein said terminal insulator includes a pair of laterally spaced apart walls, said pair of side walls of said connector position assurance member engaging said pair of laterally spaced apart walls of said terminal insulator.

19. An electrical connector for connection to a fuel injector in a motor vehicle comprising:

a terminal insulator including a hood and a shroud, said shroud defining a cavity for receiving a mating connector, said hood extending vertically from an upper side of said shroud and defining a longitudinally extending aperture therethrough, said hood including first and second locking projections, said terminal insulator further including a latch disposed between said shroud and said hood, said latch extending longitudinally and being cantilevered to said shroud by a connecting portion so as to define a first cantilevered end and a second cantilevered end, said first cantilevered end of said latch defining a longitudinally extending slot;

a connector position assurance member operative to engage said terminal insulator in a preload assembly position and a locked position, said connector position assurance member including a base wall and a pair of side walls forming a generally inverted U-shape, said connector position assurance member further including a preload stop finger which is a tapered beam cantilevered to said base wall, said preload stop finger including a portion disposed in said elongated slot of said terminal insulator to prevent said connector position assurance member from prematurely locking to the mating connector, said connector position assurance member further including first and second preload locking projections each having a retainer extending therefrom, said retainers operative to engage said first locking projection of said terminal insulator when said connection position assurance member engages said terminal insulator in said preload assembly position and further operative to engage said second locking projection of said terminal insulator when said connection position assurance member engages said terminal insulator in said locked position.

20. The electrical connector as set forth in claim 19 wherein said terminal insulator includes a pair of laterally spaced apart walls, said pair of side walls of said connector position assurance member engaging said pair of laterally spaced apart walls of said terminal insulator.

* * * * *